US005152716A

United States Patent [19]

Abe

[11] Patent Number: 5,152,716

[45] Date of Patent: Oct. 6, 1992

[54] COIN DISPENSING APPARATUS

[75] Inventor: Hiroshi Abe, Tokyo, Japan

[73] Assignee: Asahi Seiko Kabushiki Kaisha, Tokyo, Japan

[21] Appl. No.: 775,290

[22] Filed: Oct. 11, 1991

[30] Foreign Application Priority Data

Oct. 16, 1990 [JP] Japan ..... 2-107649

[51] Int. Cl.[5] ..... G07D 1/00

[52] U.S. Cl. ..... 453/57; 221/203; 453/32

[58] Field of Search ..... 453/29, 30, 32, 33, 453/34, 35, 49, 57; 221/203

[56] References Cited

U.S. PATENT DOCUMENTS 4,036,242 7/1977 Breitenstein et al. ..... 453/57 X
4,148,331 4/1979 Nicolaus ..... 453/57 X
4,574,824 3/1986 Paulsen et al. ..... 453/57
4,615,350 10/1986 Boudville ..... 453/57
5,000,718 3/1991 Abe ..... 453/57
5,064,404 11/1991 Champion ..... 221/203 X
5,066,261 11/1991 Parham ..... 453/57
5,098,340 3/1992 Abe ..... 453/57

*Primary Examiner*—Michael S. Huppert
*Assistant Examiner*—William M. Hienz
*Attorney, Agent, or Firm*—Nilles & Nilles

[57] ABSTRACT

An improvement of a coin dispensing apparatus, in particular of an agitator mounted on a central circular stage of a coin transferring rotary disc rotatably disposed in a hopper containing a plurality of coins to be dispensed. The agitator is composed of an agitating member having a plurality of agitating arms extending outwards from the central portion thereof and a resiliently deformable sheet having a thickness thinner than that of the coin, which are secured at their central portions to the central circular stage of the rotary disc such that the agitating elements rotate together with the rotary disc.

3 Claims, 2 Drawing Sheets

COIN DISPENSING APPARATUS

BACKGROUND OF THE INVENTION

1. Field of the Invention

The present invention relates to a coin dispensing apparatus usually used in vending machines, coin exchangers, game machines or the like for dispensing coins or tokens in desired numbers one at a time.

2. Related Art Statement

Hitherto, such a coin feeder is well known as disclosed in Japanese Utility Model Application Publication No. 63-49,793 and comprises a support plate inclined at an angle to the horizontal, a hopper supported on the support plate for storing coins to be dispensed in bulk and a coin transferring rotary disc disposed at one side in the hopper and rotatably supported on the inclined support plate. The rotary disc has at its central portion a central circular stage to define a coin transferring outer peripheral portion with a width larger than a diameter of a coin to be dispensed. On the outer peripheral portion of the rotary disc are extruded a plurality of coin transporting projections or pins spaced apart in the circumferential direction with a distance larger than the coin diameter such that when the rotary disc is rotated, the coins within the hopper are picked up and transported upward by the coin transporting pins and guided to an outlet chute by an outlet guide engaged with an upper peripheral of the central stage at an upper delivery portion of the coin dispensing apparatus. In the upper delivery portion, a counting roller of a coin counting switch is disposed so as to oppose to the outlet guide. Furthermore, the central stage is provided with a coin agitating member having a plurality of agitating arms extending radially from the center thereof.

One of means for improving a coin dispensation efficiency of the aforementioned type of coin dispensing apparatus is to agitate coins in the lower portion, in particular in the bottom portion of the hopper sufficiently to prevent coins from steadying at the potion so that coins are effectively picked up by all coin transporting projections provided at the outer peripheral portion of the coin transferring rotary disc.

In order to sufficiently agitate the coins, it is desirable to make a length and/or thickness of agitating arms radially extended from the center of an agitating member on the central circular stage of the rotary disc in great size capable of powerfully agitating coins in the bottom portion of the hopper. However, when the length in the radial direction and/or thickness of the agitating arms of the agitating member is great size, some problems are raised by the long and/or thick agitating arms in the upper delivery zone of the coin dispensing apparatus such that the tips or the agitating arms push coins toward the counting roll to cause counting error of the coin counting switch or carry two coins to the outlet chute at a time to clog a coin passage of the outlet chute.

Therefore, the length and thickness of the agitating arm have been limited and sequently the coins in the bottom portion of the hopper could not be sufficiently agitated by the agitating arms.

SUMMARY OF THE INVENTION

An object of the present invention is to provide a coin dispensing apparatus including an agitator capable of sufficiently agitating coins in the bottom portion of the hopper without the aforementioned problems in the prior art.

According to the present invention, a coin dispensing apparatus comprises a support plate inclined at an angle to the horizontal, a hopper supported on the support plate for storing coins to be dispensed in bulk and a coin transferring rotary disc disposed at one side in the hopper and rotatably supported on the inclined support plate, the rotary disc having at its central portion a central circular stage to define a coin transferring outer peripheral portion of a width larger than a diameter of a coin to be dispensed and at the outer peripheral portion a plurality of coin transporting pins spaced apart in the circumferential direction with a distance larger than the coin diameter, and the central circular stage being provided on its upper surface with a flexible agitating sheet having a thickness thinner than that of the coin to be dispensed and an agitating member having a plurality of agitating arms extending radially outward from the central portion of the agitating member on the flexible agitating sheet, the flexible agitating sheet and the agitating member being secured at their central portions to the central circular stage to rotate together therewith.

The flexible agitating sheet is resiliently deformable and is preferably made of elastomer material.

With the aforementioned arrangement, the outer peripheral edge of the agitating sheet can be extended to the outer peripheral edge of the central circular stage without problems of guiding two coins into the outlet chute or pushing coins against the counting roller of the delivery coin counting switch. The flexible agitating sheet can be resiliently deformed into a corrugated shape at a portion thereof by engaging with coins in the bottom portion of the hopper so that the flexible agitating sheet is capable to move the coins in the bottom portion.

Therefor, the agitating arms of the agitating member can effectively agitate coins moved from the bottom portion of the hopper to urge them into the coin transferring outer peripheral portion of the rotary disc. Thus, the coin picking up efficiency, i.e. coin dispensing efficiency by the coin transporting pins in the coin transferring outer peripheral portion can be improved.

DETAILED DESCRIPTION OF A PREFERRED EMBODIMENT

Figure 3:
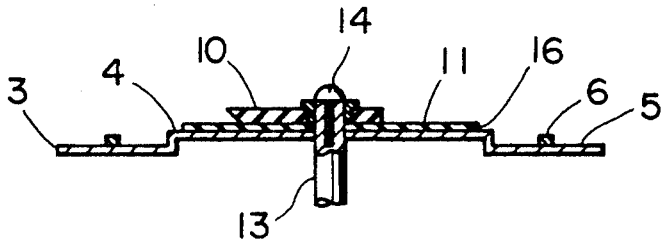
FIG. 3 is a sectional view taken along a line 3—3 in FIG. 2.

The accompanying drawings illustrate an embodiment of the coin dispensing apparatus according to the present invention. In the embodiment, a support plate 1 is supported at an angle to the horizontal by a support frame and a hopper 2 is mounted on the supported plate to be adapted for storing coins to be dispensed in bulk. A coin transferring rotary disc 3 is rotatably supported on the inclined support plate 1 at one side of the hopper by means of a bearing device (not shown) so as to be rotated in a position inclined at a predetermined angle to the horizontal by means of a rotating shaft 13 (FIG. 3).

The rotary disc 3 has in its central portion a central circular stage 4 having substantially the same height as a thickness of the coin to be dispensed and a diameter for defining a ring shaped coin transferring outer peripheral portion 5 having a width larger than a diameter of the coin. The coin transferring outer peripheral portion 5 is provided with a plurality of coin transporting pins 6 which have substantially the same height as a thickness of the coin, and are spaced apart in the circumferential direction with a distance larger than the coin diameter. An outer guide 7 is secured to the support plate 1 and is extended across the outer peripheral portion 5 of the rotary disc 3 in the upper delivery portion of the coin dispensing apparatus so as to guide coins from the upper peripheral edge of the central circular stage 4 to an outlet chute 8 in a conventional manner. A counting roller 9 of a coin counting switch is retractably opposed to the outlet guide 7 at an upper position thereof.

With the arrangement mentioned above, when the coin transferring rotary disc 3 is rotated in a position inclined at an angle to the horizontal within the hopper 2, the coins are picked up from the lower portion of the hopper and transported to the upper delivery portion by the transporting pins 6, respectively. At the upper delivery portion, the lifted coins are pushed from the outer peripheral edge of the central circular stage 4 onto the outlet guide 7 to push the counting roller 9 upwards against a spring force, and after the coins actuate the outlet coin counting switch, the coins are dispensed through the outlet chute 8.

The central circular stage 4 of the coin transferring rotary disc 3 is provided on its upper surface with a resiliently deformable flexible agitating sheet 11 made of rubber material and an agitating member having three agitating arms 10 extending radially outwards which are secured to a rotating shaft 13 at the central portions thereof by means of a set screw 14 so as to rotate together with the rotary disc.

Figure 1:
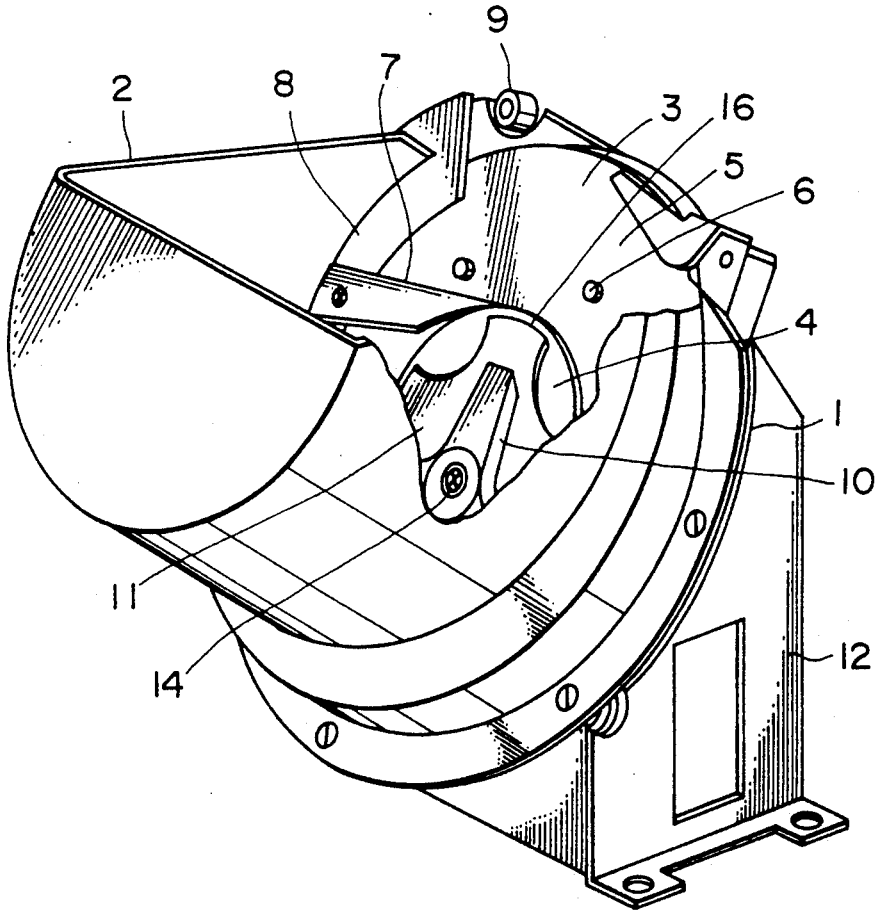
FIG. 1 is a schematic perspective view of a coin dispensing apparatus according to the present Invention.
Figure 2:
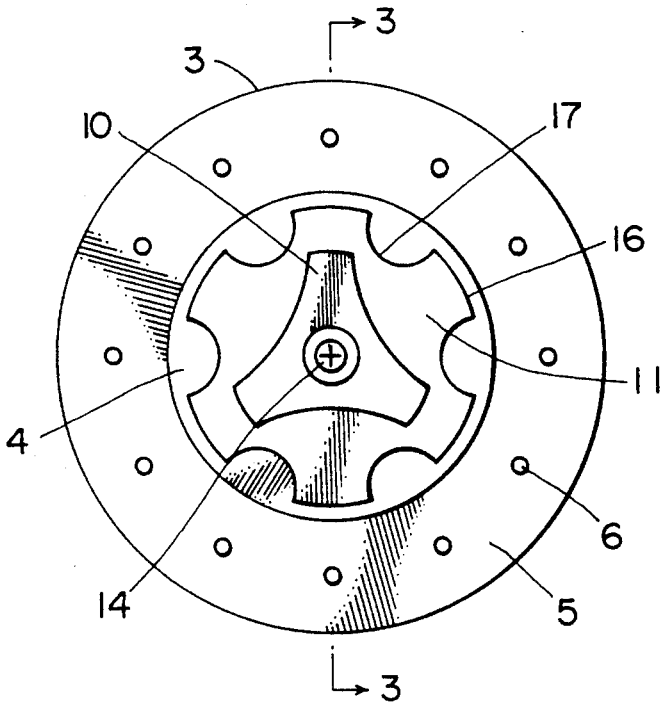
FIG. 2 is an elevational view of a coin transferring rotary disc with a coin agitating member and a flexible agitating sheet on a central circular stage.

The flexible agitating sheet 11 has a thickness for example 1 mm which is thinner than the thickness of the coin to be dispensed and a diameter smaller than that of the central circular stage 4 so that the outer peripheral edge 16 does not extend from the outer peripheral edge of the central circular stage. The flexible agitating sheet 11 may be provided at the outer peripheral portion with semicircular cutout portions 17 as shown in FIG. 2 so as to easily engage the coins.

What is claimed is:

1. A coin dispensing apparatus comprising a support plate inclined at an angle to the horizontal, a hopper supported on the support plate for storing coins to be dispensed in bulk and a coin transferring rotary disc disposed at one side in the hopper and rotatably supported on the inclined support plate, the rotary disc having at its central portion a raised central circular stage to define a coin transferring outer peripheral disc portion of a width larger than a diameter of a coin to be dispensed, the outer peripheral disc portion having a plurality of coin transporting pins spaced apart in the circumferential direction by a distance larger than the coin diameter, the central circular stage being provided on its upper surface with a flexible agitating sheet having a thickness thinner than that of the coin to be dispensed, the apparatus further comprising an agitating member having a plurality of agitating arms extending radially outward from the central portion of the agitating member, the agitating member being disposed on an upper surface of the flexible agitating sheet, the flexible agitating sheet and the agitating member being secured at their central portions to the central circular stage to rotate together with the rotary disc.

2. The apparatus claimed in claim 1, wherein the flexible agitating sheet is resiliently deformable.

3. The apparatus claimed in claim 1, wherein the flexible agitating sheet is made of elastomer material.

* * * * *